US005320508A

United States Patent [19]

Kiefer

[11] Patent Number: 5,320,508

[45] Date of Patent: Jun. 14, 1994

[54] ROTARY PUMP AND ROTOR-SHAFT SUBASSEMBLY FOR USE THEREIN

[75] Inventor: Steven K. Kiefer, Battle Creek, Mich.

[73] Assignee: Eaton Corporation, Cleveland, Ohio

[21] Appl. No.: 102,444

[22] Filed: Aug. 5, 1993

[51] Int. Cl.[5] ..... F01C 1/18; F01C 1/24

[52] U.S. Cl. ..... 418/206; 29/889.6; 29/889.72; 164/516

[58] Field of Search ..... 418/206, 205; 29/889.6, 29/889.7, 889.72; 164/516

[56] References Cited

U.S. PATENT DOCUMENTS 4,971,536 11/1990 Takeda et al. ..... 418/206

5,048,368 9/1991 Mrdjenovich et al. ..... 164/516

FOREIGN PATENT DOCUMENTS 0251443 5/1926 United Kingdom ..... 418/206

*Primary Examiner*—Richard A. Bertsch

*Assistant Examiner*—Charles G. Freay

*Attorney, Agent, or Firm*—L. J. Kasper

[57] ABSTRACT

A rotor-shaft subassembly (33) is disclosed of the type for use in a Roots blower supercharger. The subassembly includes a rotor (39) mounted for rotation on a driveshaft (41) at forward (49,53) and rearward (57,51) axially spaced-apart locations. The rotor (39) is a cast member with each lobe thereof (61,63,65) defining a hollow chamber (71,73,75). The rotor includes a cylindrical web portion (67) disposed axially between the forward and rearward locations. Each lobe cooperates with the web portion to define a core opening (81,83,85) adapted to facilitate removal of a core from the hollow chamber after completion of the casting process. Each core opening provides open communication between its respective hollow chamber and the shaft bore, and each is disposed axially between the forward and rearward locations, so that after the rotor is press-fit on the shaft, there is no leak path of pressurized air into the hollow chambers.

11 Claims, 4 Drawing Sheets

ROTARY PUMP AND ROTOR-SHAFT SUBASSEMBLY FOR USE THEREIN

BACKGROUND OF THE INVENTION

The present invention relates to rotary pumps, compressors, and blowers, and particularly to blowers of the Roots type. More particularly, the present invention relates to pumps and blowers of the type having rotors non-rotatably attached to their shafts, such as by press-fitting or some other suitable means.

Although the present invention may be used with various types of pumps and blowers, it is especially advantageous when used with a Roots type blower, and will be described in connection therewith.

Rotary blowers of the Roots type typically include a pair of meshed, lobed rotors, with each of the rotors being mounted on a shaft, and each shaft having mounted thereon a timing gear. Rotary blowers, and particularly Roots blowers, which are employed as superchargers for internal combustion engines normally operate at relatively high speeds, typically in the range of 10,000 to 20,000 rpm.

As is well known to those skilled in the art, it is preferable that the rotors mesh with each other, to transfer volumes of air from an inlet port to an outlet port, without the rotors actually touching each other, although it is known to permit certain types of coated rotors to have limited contact. It is now becoming more common to utilize some sort of clutch (typically, electrically operated) disposed between an input pulley and the blower, in order to be able to disengage the blower when its operation is not required. The durability and life of such a clutch, as it engages and disengages the blower, is determined largely by the inertia of the rotors which, in turn, is a function of the size and mass (weight) of the rotor lobes. Typical Roots blowers produced commercially by the assignee of the present invention for use as internal combustion engine superchargers have a lobe radius in the range of about 2 inches (about 5 cm) to about 3 inches (about 7.5 cm).

The desire to reduce the rotating mass, and therefore the inertia, of the rotor lobes has caused those working in the art to attempt to develop rotors which do not have solid lobes, i.e., at least some portion of each lobe is "hollow". In some of the so-called "hollow" rotor designs, the "hollow" portion would be in communication with some portion of the pressurized air, thus creating a leakage path reducing volumetric efficiency. In other attempts at producing hollow lobed rotors, the hollow portion of each lobe was wholly within the lobe, and therefore would not result in a leakage path. However, such rotors were typically of a two-piece type of construction, requiring the addition of either an "end-cap" to enclose the hollow chamber, or some sort of plug arrangement. In either case, one result was the need for subsequent, additional machining operations on the rotor, thus making the rotor economically unacceptable.

SUMMARY OF THE INVENTION

Accordingly, it is an object of the present invention to provide a rotor design, and a rotor-shaft subassembly for use in a rotary pump or blower which overcomes the above-described drawbacks of the prior art.

It is a more specific object of the present invention to provide such a rotor in which each of the rotor lobes is hollow, thus reducing the weight and the inertia of the rotor, but wherein the rotor-shaft subassembly, when in use in the pump or blower, does not permit communication of pressurized air with the hollow cavity defined by the lobes.

The above and other objects of the invention are accomplished by the provision of an improved rotor-shaft subassembly for use in a rotary pump of the type having a housing defining an inlet and an outlet, and first and second parallel, transversely overlapping cylindrical chambers, and first and second meshed lobed rotors disposed in said first and second chambers, respectively. The first and second rotors are mounted for rotation with first and second elongated driveshafts. Each rotor-shaft subassembly includes a rotor comprising a one-piece member defining a plurality of lobes, and a central shaft bore, the shaft bore being in fixed, operable engagement with the driveshaft at forward and rearward axially spaced-apart locations.

The improved subassembly is characterized by the rotor comprising a cast member and each of the lobes of the rotor defining a hollow chamber. The rotor includes a generally cylindrical web portion surrounding the driveshaft, and disposed axially between the forward and rearward locations. Each of the lobes cooperates with the cylindrical web portion to define a core opening, adapted to facilitate removal of a core from the hollow chamber. Each of the core openings provides open communication between its respective hollow chamber, and the shaft bore, the core opening comprising the only communication between its respective hollow chamber and the exterior of the rotor. Each of the core openings is disposed axially between the forward and rearward locations.

DESCRIPTION OF THE PREFERRED EMBODIMENT

Figure 1:
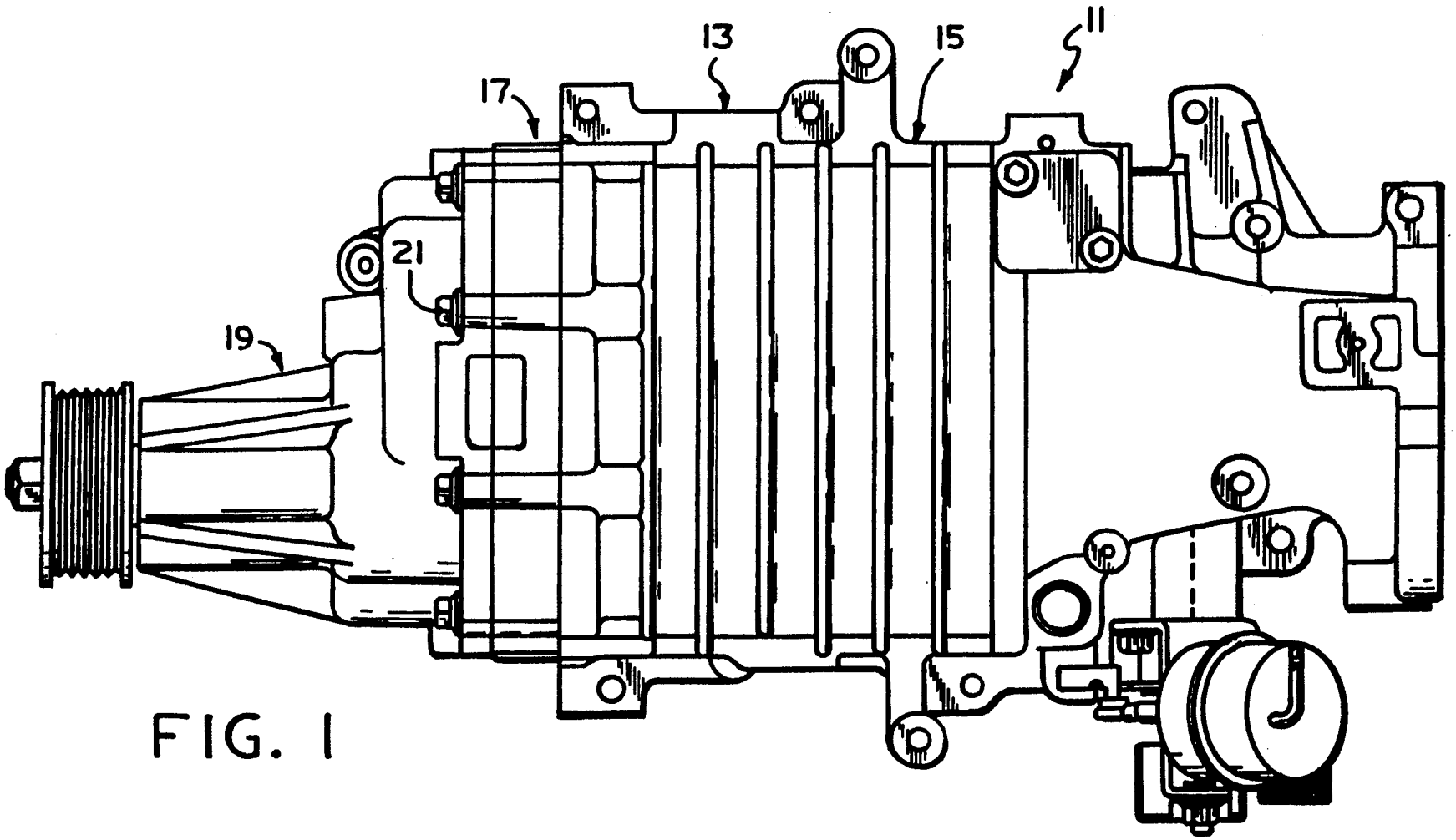
FIG. 1 is a top plan view of a Roots type blower of the type with which the present invention may be utilized.
Figure 2:
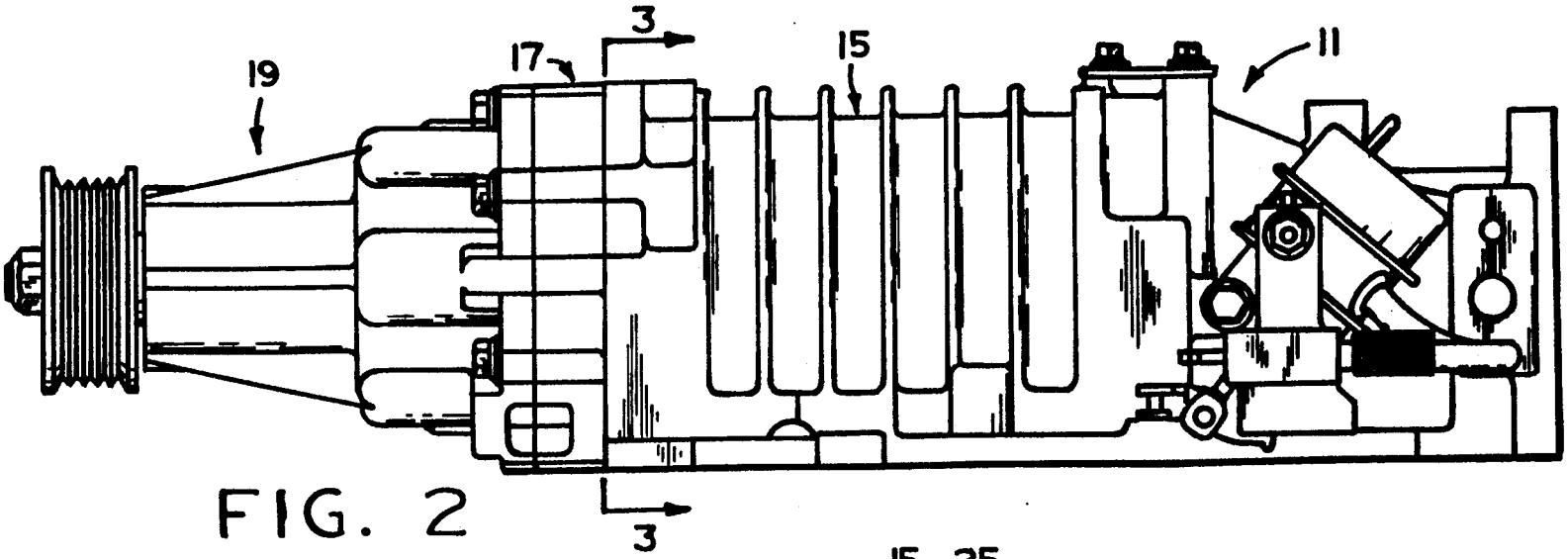
FIG. 2 is a side elevation view of the Roots type blower shown in FIG. 1.
Figure 3:
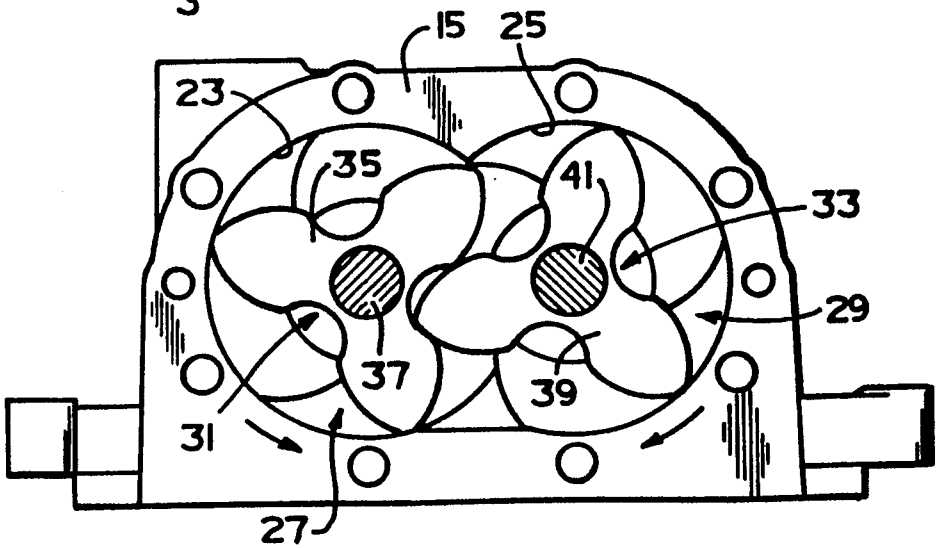
FIG. 3 is a transverse cross-section, taken on line 3—3 of FIG. 2, and on approximately the same scale.

Referring now to the drawings, which are not intended to limit the invention, FIGS. 1 through 3 illustrate a rotary pump or blower of the Roots type, generally designated 11. The blower 11 is illustrated and described in greater detail, and may be better understood by reference to U.S. Pat. Nos. 4,828,467 and 5,118,268, both of which are assigned to the assignee of the present invention and incorporated herein by reference.

Pumps, compressors, and blowers of the type to which the invention relates are used typically to pump or transfer volumes of compressible fluid, such as air, from an inlet port opening to an outlet port opening, without compressing the air in the transfer volumes prior to exposing it to higher pressure air at the outlet opening. The rotors operate somewhat like gear pumps, i.e., as the rotor teeth or lobes move out of mesh, air flows into volumes or spaces defined by adjacent lobes on each rotor. The air in the volumes is then trapped between the adjacent unmeshed lobes as the rear (trailing) lobe thereof moves into a sealing (but non-contact) relationship with the wall surfaces of the chamber. The volumes of air are transferred or directly exposed to air at the outlet opening when the front (leading) lobe of each transfer volume traverses the boundaries of the outlet port opening.

The blower 11 comprises a housing assembly 13 including a main housing member 15, a bearing plate member 17, and a drive housing member 19. The three members 15, 17, and 19 are secured together by a plurality of screws 21. Referring now also to FIG. 3, the main housing member 15 is a unitary member defining cylindrical wall surfaces 23 and 25 which define parallel, transversely overlapping cylindrical chambers 27 and 29, respectively. Although not illustrated herein, the main housing member 15 also defines an inlet port opening and an outlet port opening, and typically various other ports, slots, and openings, all of which are illustrated and described in great detail in above-incorporated U.S. Pat. No. 5,118,268.

The chambers 27 and 29 have rotor-shaft subassemblies 31 and 33, respectively, mounted therein for counter-rotation, having axes substantially coincident with the respective axes of the chambers 27 and 29.

The two rotor-shaft subassemblies 31 and 33 are substantially identical, except that the subassembly 31 has a helical twist in the counterclockwise direction as viewed in FIG. 3, while the subassembly 33 has a helical twist in the clockwise direction. Otherwise, however, and for purposes of explaining the present invention, the subassemblies 31 and 33 will be considered identical, and only one will be described in detail hereinafter. The subassembly 31 includes a rotor 35 fixed for rotation with a shaft 37. Similarly, the subassembly 33 includes a rotor 39 fixed for rotation with a shaft 41. As is well known to those skilled in the art, the shaft 41 comprises an input shaft, and is housed within the drive housing member 19.

Figure 4:
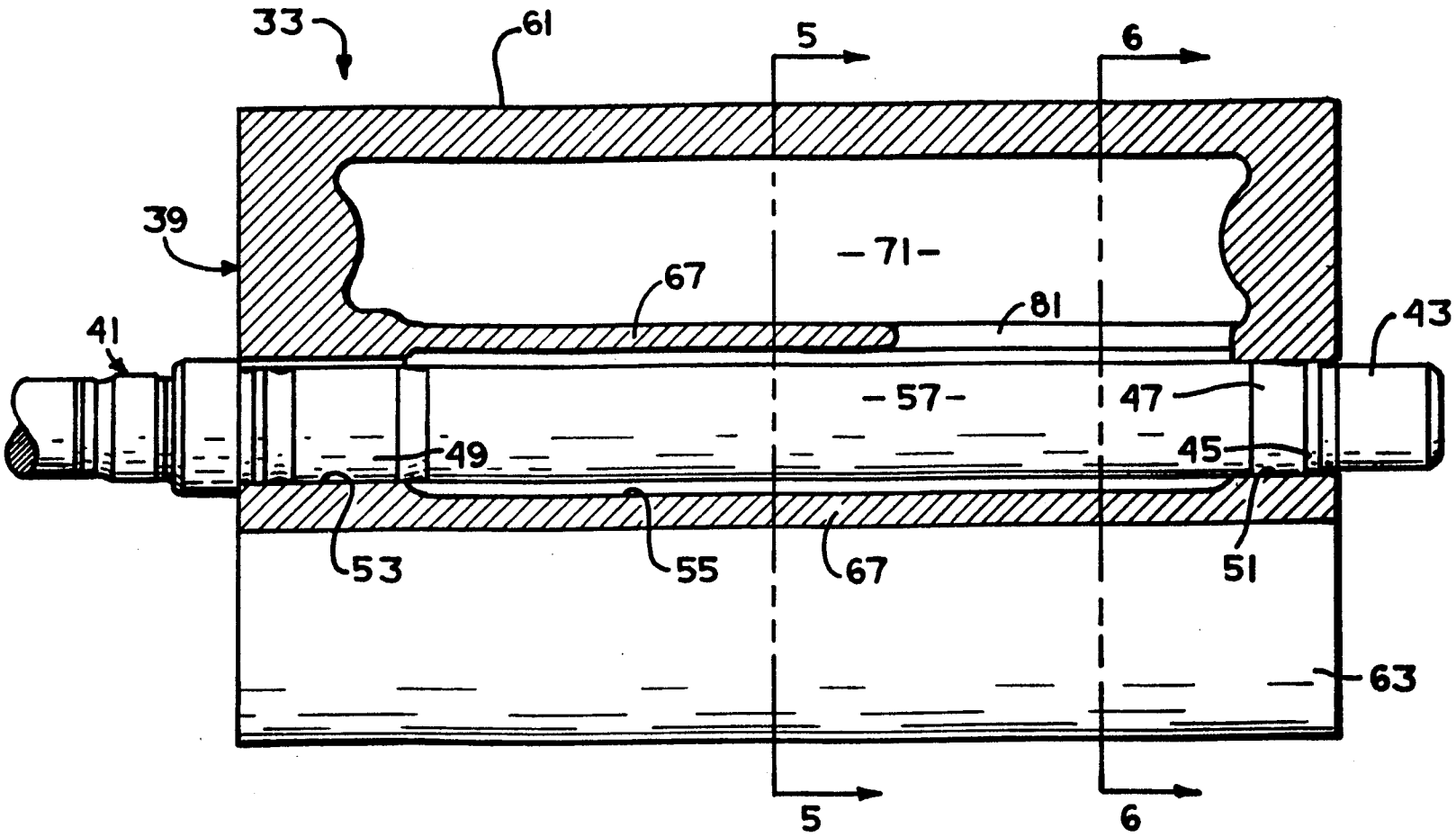
FIG. 4 is an axial cross-section through a rotor-shaft subassembly made in accordance with the present invention.
Figure 6:
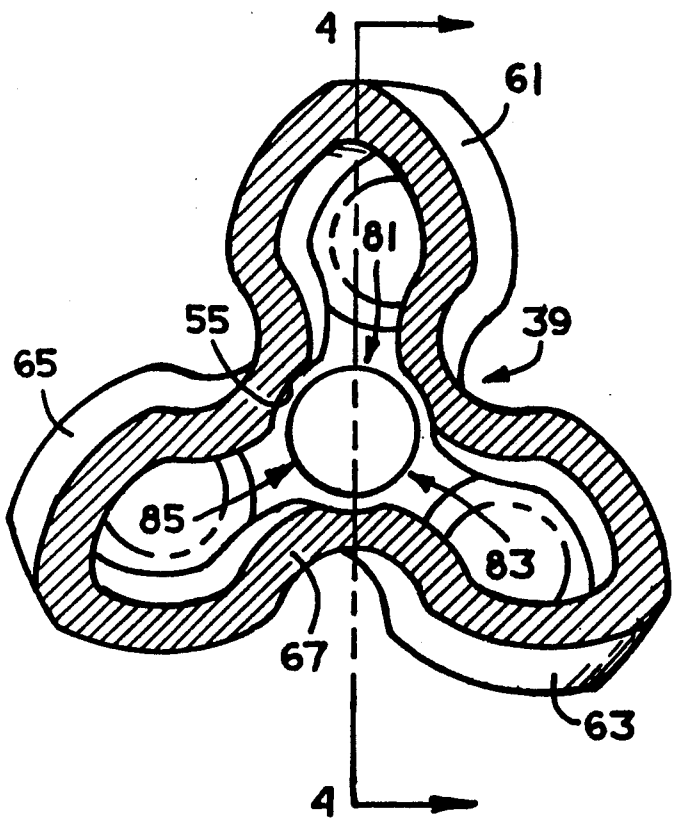
FIG. 6 is a transverse cross-section, taken on line 6—6 of FIG. 4, and illustrating another aspect of the present invention.
Figure 5:
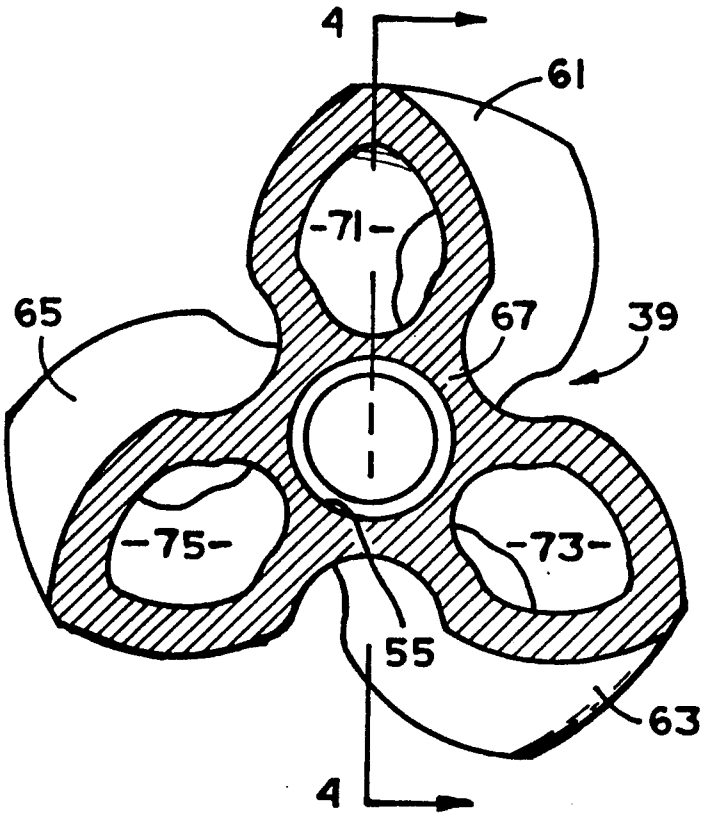
FIG. 5 is a transverse cross-section, taken on line 5—5 of FIG. 4, and illustrating one aspect of the present invention.

Referring now primarily to FIGS. 4 through 6, the rotor 39 and shaft 41 are shown in somewhat greater detail, but with the shaft 41 being shown only in FIG. 4. To facilitate an understanding of the structure, and the relationship of the various figures, it should be noted that FIG. 4 is taken on line 4—4 of each of FIGS. 5 and 6. Furthermore, FIG. 4 is drawn as if the rotor 39 were a straight-lobed rotor, for ease of illustration, whereas the views shown in FIGS. 5 and 6 are actually rotatably displaced from each other about 20 degrees.

The shaft 41 defines a rearward (to the right in FIG. 4) terminal portion 43, which is typically received within the inner race of a bearing set (not illustrated herein). Disposed adjacent the terminal portion 43 is a close-clearance land 45, and forwardly thereof, is a groove 47. Disposed toward the forward end of the shaft 41 is a press-fit region 49. The rotor 39 defines a rearward bore portion 51 and a forward bore portion 53. Disposed axially between the bore portions 51 and 53 is an enlarged-diameter bore portion 55. Axially disposed between the groove 47 and the press-fit region 49 is a main shaft portion 57, having a generally constant diameter over its axial length, the shaft portion 57 being radially spaced-apart from the bore portion 55 as shown in FIG. 4, and its rearward portion also comprising a press-fit region.

In the subject embodiment, although not an essential feature of the present invention, the shaft 41 is pressed into the rotor 39 from the front (left end in FIG. 4), such that the main shaft portion 57 of the shaft 41 is press-fit into the rearward bore portion 51. At the same time, the press-fit region 49 is being pressed into the forward bore portion 53. The method used to put the bore of the rotor in fixed, operable engagement with the shaft 41 is illustrated and described in greater detail in above-incorporated U.S. Pat. No. 4,828,467. Although the particular arrangement for engaging the rotor and the shaft is not an essential feature of the invention, it is one important feature of the invention that there be some form of fixed, operable engagement between the rotor and the shaft at forward and rearward axially spaced-apart locations. In the subject embodiment, the rearward location comprises the press-fit of the shaft portion 57 into the rearward bore portion 51, while the forward location comprises the press-fit of the region 49 into the forward bore portion 53. Preferably, the two engagement locations are capable of transmitting torque as well as being substantially air-tight. The significance of these forward and rearward axially spaced-apart engagement locations will become apparent subsequently.

Referring again to FIGS. 5 and 6, in conjunction with FIG. 4, the rotor 39 comprises three separate lobes 61, 63, and 65. In addition, the rotor 39 defines a generally cylindrical web portion 67. As may best be seen in FIG. 4, the cylindrical web portion 67 is radially thicker between adjacent lobes and radially thinner at each lobe. Although the web portion 67 is described as though it were an element separate from the lobes 61,63,65, those skilled in the art will appreciate that the lobes and the web are all one integral piece, preferably a one-piece casting, as will be described subsequently. During the course of development of the present invention, it was determined that one important aspect of the web portion 67 is the extra rigidity and strength which it provides to the overall rotor. One important criterion for the rotor of the type to which the invention relates is the deflection which occurs, in the circumferential direction, at each of the lobe tips (outer diameter). It has been found that the presence of the web portion 67 results in a major reduction in lobe deflection.

The lobes 61, 63, and 65 define hollow chambers 71, 73, and 75, respectively. In accordance with one important aspect of the present invention, the rotor 39, as well as the shaft bore 55, and each of the hollow chambers 71, 73, and 75 is formed by a casting process, which will be described in greater detail subsequently. However, it should be understood by those skilled in the art that the present invention does not reside in the particular process for casting the rotor, or the details, materials, operating parameters, etc. of the casting process. Instead, the present invention resides in the configuration of the rotor which facilitates producing the rotor by the particular casting process, wherein the resulting rotor and shaft subassembly achieve the above-stated object of not permitting communication of pressurized air to the hollow chambers 71, 73, and 75.

Referring now primarily to FIG. 6, in conjunction with FIG. 4, it is one essential feature of the present invention that the web portion 67 is not circumferentially continuous (as it is shown to be in FIG. 5) over its entire axial length. Instead, each lobe cooperates with the web portion 67 to define a core opening, whereby the respective hollow chamber is in open communication with the bore 55. Therefore, the lobe 61 cooperates with the web portion 67 to define a core opening 81, providing communication between the hollow chamber 71 and the bore 55. Similarly, the lobe 63 cooperates with the web portion 67 to define a core opening 83, providing communication between the hollow chamber 73 and the bore 55. Finally, the lobe 65 cooperates with the web portion 67 to define a core opening 85, providing communication between the hollow chamber 75 and the bore 55. The reason for the use of the term "core opening" in regard to the elements 81, 83, and 85 will become apparent subsequently.

As mentioned previously, the present invention does not reside in the details of the particular casting process, and it is anticipated that it is within the ability of those skilled in the casting art to cast the rotor 39. Therefore, the casting process will be described only briefly hereinafter, primarily for the purpose of explaining the significance of the structural features already introduced, as well as the benefits derived from the invention.

In a preferred embodiment of casting the rotor 39, in which the investment casting process is used, the first step is to provide a wax form which corresponds exactly to the configuration of the desired rotor casting. In order to provide a wax form conforming to the shape of the rotor 39, it would probably be necessary to make the form in two pieces (one piece being generally cup-shaped, and the other comprising an "endcap"). Subsequently, the wax form is covered with a ceramic coating, which is initially in the form of a slurry, but which then hardens in place on the wax form. Typically, the ceramic coating would be in the range of about ⅛ to about ¼ of an inch in thickness, and would cover every exposed surface of the "rotor" (i.e., the wax form), including the bore portion 55 and the interior surface of each of the hollow chambers 71, 73, and 75. After the ceramic coating is in place and has hardened, the wax and ceramic assembly is heated to cure the ceramic, and during the curing of the ceramic, the wax melts and is removed. Therefore, all that remains is a hollow ceramic form, the interior of which conforms to the desired configuration of the rotor casting.

Once the ceramic mold has been cured, and the molten wax removed, the next step is to cast the rotor by gravity feeding the molten metal (typically aluminum) into the mold. The molten metal may also be "injected" into the mold, as that term is normally understood in conjunction with the well-known injection molding process, but it will be understood that as used hereinafter and in the claims, references to "injecting" the molten metal will be understood merely in the generic sense of feeding the molten metal into the mold. After an appropriate period of time, when the molten metal has solidified and cooled, the final step is to remove the ceramic mold, which is one of the reasons for the presence of the core openings 81, 83, and 85. Typically, the ceramic mold is removed by some method such as a high-pressure water jet. After the ceramic mold has been removed from the shaft bore 51, 53, and 55 of the rotor, the water jet can then be extended through the core opening 81 to remove the portion of the ceramic mold which defines the interior surface of the hollow chamber 71, and the same may be done for the other hollow chambers 73 and 75.

After all of the ceramic mold material is removed, the result is an as-cast member of the general configuration shown in FIGS. 5 through 6. Subsequently, the profile of the lobes, the end surfaces of the rotor, and the bore portion 51 and bore portion 53 need to be finish machined. After the machining is completed, it may be seen that the core openings 81, 83, and 85 provide the only open communication between the exterior of the rotor 39 and the hollow chambers 71, 73, and 75, respectively. As used herein, and in the appended claims, the reference to communication between the exterior and the chambers through the core openings will be understood to refer only to the rotor itself, prior to the assembly of the rotor 39 and the shaft 41. In other words, after the shaft 41 is pressed into the rotor 39 as described previously, forming the forward and rearward engagement locations 49,53 and 57,51, the hollow chambers 71,73 and 75 are no longer in communication at all with the exterior of the rotor, which is one of the objects of the present invention, i.e., to provide a rotor-shaft subassembly wherein the hollow chambers or cavities defined by the rotor lobes do not permit communication (a leak path) of pressurized air into the hollow chambers.

As was mentioned previously, the presence of the web portion 67 is significant in adding rigidity to the rotor, thus reducing undesirable deflection of the lobes. At the same time, the core openings 81, 83, and 85 are essential for removal of the ceramic mold material. Therefore, it will be understood by those skilled in the art that it is desirable to reach an appropriate compromise between having the web portion 67 as long as possible, for maximum rigidity, and having the core openings 81, 83, and 85 as large as possible, to facilitate removal of the mold material. It is believed to be within the ability of those skilled in the relevant arts to reach the appropriate compromise, subsequent to a reading and understanding of the present specification.

Although a preferred embodiment of the casting of the rotor 39 has been described in connection with the investment casting process, it should be understood by those skilled in the art that various other casting methods may be utilized. As merely one example, a "semi-permanent mold" method may be utilized in which the outer profile of the rotor is formed by means of a standard metal injection molding dye, but wherein the bore portions 51, 53, and 55, and the hollow chambers 71, 73, and 75 are formed by sand cores. In utilizing such a semi-permanent mold casting process, after the rotor is formed and the molten metal has cooled and solidified, the sand core would be removed, utilizing the core openings 81, 83, and 85, in much the same manner as was described previously.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A rotor-shaft subassembly for use in a rotary pump of the type having a housing defining an inlet and an outlet, and first and second parallel, transversely overlapping cylindrical chambers, and first and second rotor-shaft subassemblies including first and second meshed lobed rotors, respectively, disposed in said first and second chambers, respectively, and mounted for rotation with first and second elongated driveshafts, respectively; each rotor-shaft subassembly including said rotor comprising a one-piece member defining a plurality of lobes and a central shaft bore, said shaft bore being in fixed, operable engagement with said driveshaft at forward and rearward axially spaced-apart locations; characterized by:

(a) said rotor comprising a cast member;

(b) each of said lobes of said rotor defining a hollow chamber;

(c) said rotor including a generally cylindrical web portion surrounding said driveshaft and disposed axially between said forward and rearward locations;

(d) each of said lobes cooperating with said cylindrical web portion to define a core opening, adapted to facilitate removal of a core from said hollow chamber;

(e) each of said core openings providing open communication between its respective hollow chamber and said shaft bore, said core opening comprising the only communication between its respective hollow chamber and the exterior of said rotor; and (f) each of said core openings being disposed axially between said forward and rearward locations.

2. A rotor-shaft subassembly as claimed in claim 1, characterized by said rotor including at least three lobes.

3. A rotor-shaft subassembly as claimed in claim 1, characterized by said plurality of lobes and said generally cylindrical web portion comprising a single, integrally-formed cast member.

4. A rotor-shaft subassembly as claimed in claim 1, characterized by said forward and rearward axially spaced-apart locations being disposed at approximately the axially opposite end portions of said rotor, said generally cylindrical web portion extending axially over substantially the entire axial distance between said forward and rearward spaced-apart locations.

5. A rotor-shaft subassembly as claimed in claim 4, characterized by each of said core openings being disposed axially adjacent one of said forward and rearward locations.

6. A rotor-shaft subassembly as claimed in claim 1, characterized by said rotor comprising an investment cast member.

7. A method of investment casting a rotor for use in a rotor-shaft subassembly; said rotor comprising a plurality of lobes adapted to be in fixed, operable engagement with a driveshaft at forward and rearward axially spaced-apart locations of a shaft bore; each of said lobes of said rotor defining a hollow chamber, said rotor including a generally cylindrical web portion adapted to surround said driveshaft, and disposed axially between said forward and rearward locations; each of said lobes cooperating with said cylindrical web portion to define a core opening providing communication between its respective hollow chamber and said shaft bore, the method being characterized by:

(a) providing a form conforming substantially to the desired, as-cast configuration of said rotor;

(b) coating substantially the entire exposed surface of said form with a hardenable material in a thickness sufficient to form a mold defining a mold cavity;

(c) removing said form from said mold cavity;

(d) injecting molten metal into said mold cavity and permitting said molten metal to solidify; and (e) removing said hardenable material comprising said mold, including the step of removing through each core opening that portion of the mold defining its respective hollow chamber.

8. A method as claimed in claim 7, characterized by the step of providing a form corresponding to said rotor comprises the steps of providing a generally cup-shaped piece, providing an endcap, and joining said cup-shaped piece and said endcap to comprise said form.

9. A method as claimed in claim 7, characterized by the step of coating comprises coating said form with a ceramic slurry, and further including the step of curing said ceramic material to form said mold.

10. A method as claimed in claim 7, characterized by said form comprising a wax material, and the step of removing said form from said mold cavity comprises the step of heating the combination of said form and said mold to a temperature effective to melt said wax form.

11. A method as claimed in claim 7, characterized by the step of removing said mold comprises the step of directing a high-pressure liquid at said hardenable material comprising said mold, said high pressure liquid being directed through said core openings to remove those portions of said mold defining said hollow chambers.

* * * * *